United States Patent [19]

Heyne

[11] Patent Number: 5,076,195

[45] Date of Patent: Dec. 31, 1991

[54] BOAT TARP COVER DEVICE

[76] Inventor: Micheal Heyne, 5267 5th Ave. N., Grand Forks, N. Dak. 58203

[21] Appl. No.: 537,074

[22] Filed: Jun. 12, 1990

[51] Int. Cl.[5] ..... B63B 17/00

[52] U.S. Cl. ..... 114/361

[58] Field of Search ..... 114/343, 344, 361, 219; 296/136, 77.1, 81, 82; 135/88, 102, 904; 150/166, 154

[56] References Cited

U.S. PATENT DOCUMENTS

| | | | |
|---|---|---|---|
| 3,399,687 | 9/1968 | Frieder | 114/361 |
| 4,960,302 | 10/1990 | Walters | 150/166 |

FOREIGN PATENT DOCUMENTS

| | | | |
|---|---|---|---|
| 1176537 | 10/1984 | Canada | 114/361 |
| 1108715 | 1/1958 | France | 114/361 |

*Primary Examiner*—Jesus D. Sotelo
*Attorney, Agent, or Firm*—Robert E. Kleve

[57] ABSTRACT

The invention comprises a boat tarp cover for covering the forward portion of the boat. The boat tarp has a pair of side portions connected together at their upper edges for engaging about the nose of the forward end of the boat. The one side portion of the tarp has elastic strips mounted at their one ends to the lower edge portions of the one side portion with adhesive mounted at their other ends. Similar adhesive members are mounted to the other side portion at its lower edge whereby the elastic strips may be drawn around the forward keel portion of the boat and the velcro of the elastic strips attached to the velcro of the other side portion to attach the lower forward portions of the side portions of the tarp together about the keel of the boat.

3 Claims, 1 Drawing Sheet

BOAT TARP COVER DEVICE

This invention relates to boat tarp cover devices and the like.

It is an object of the invention to provide a novel boat cover for easily and rapidly covering only the forward porions of a boat to protect it against road material being thrown up against the forward portion of the boat by a vehicle when the boat is being towed behind the vehicle on a roadway.

It is another object of the invention to provide a novel cover for covering only the forward portion of a boat.

Further objects and advantages of the invention will become apparent as the description proceeds and when taken in conjunction with the accompanying drawing wherein.

Briefly stated, the invention comprises a boat tarp cover for covering the forward portion of a boat to protect portions of the top and forward side portions of the boat from rocks and other road material being thrown up against it by a vehicle as the boat is being towed on a trailer by the vehicle. The cover is attached to the boat by placing the tarp over the nose of the boat and draping the sides of the tarp downward about the sides of the boat. Elastic strips have one ends attached to the lower edge of one side portion of the tarp and have adhesive mounted to the other ends. The strips are drawn across the keel of the boat and the adhesive of the elastic strips attached to the adhesive on the other side portion of the tarp to secure the sides of the tarp about the bottom of the forward portion of the boat.

Figure 1:
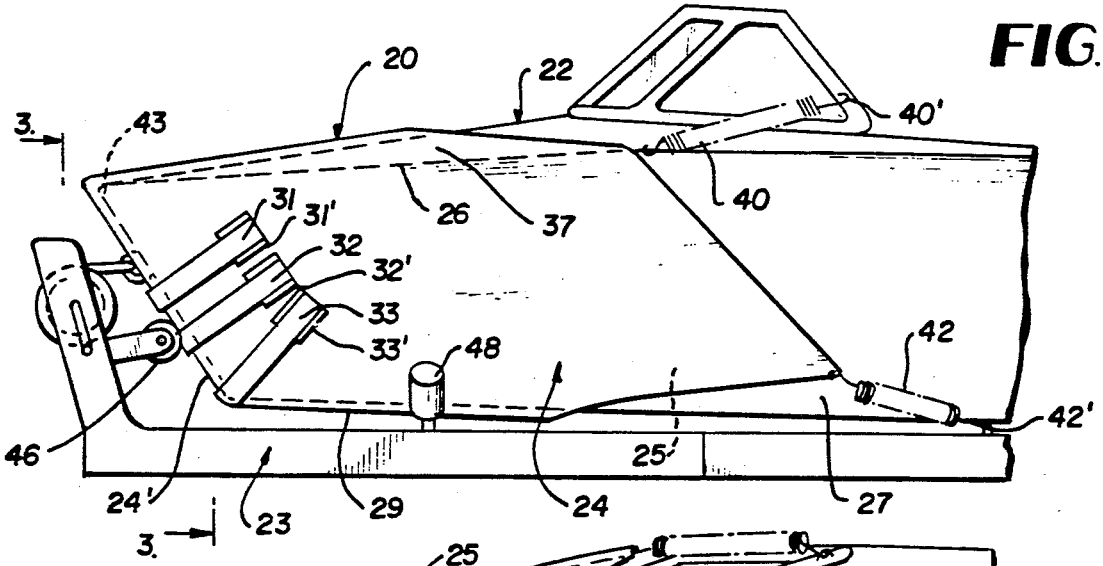
FIG. 1 is a side elevational view of the boat cover device shown mounted or attached to the forward portion of a boat, while the boat is mounted to a trailer for transporting the boat on the trailer.
Figure 2:
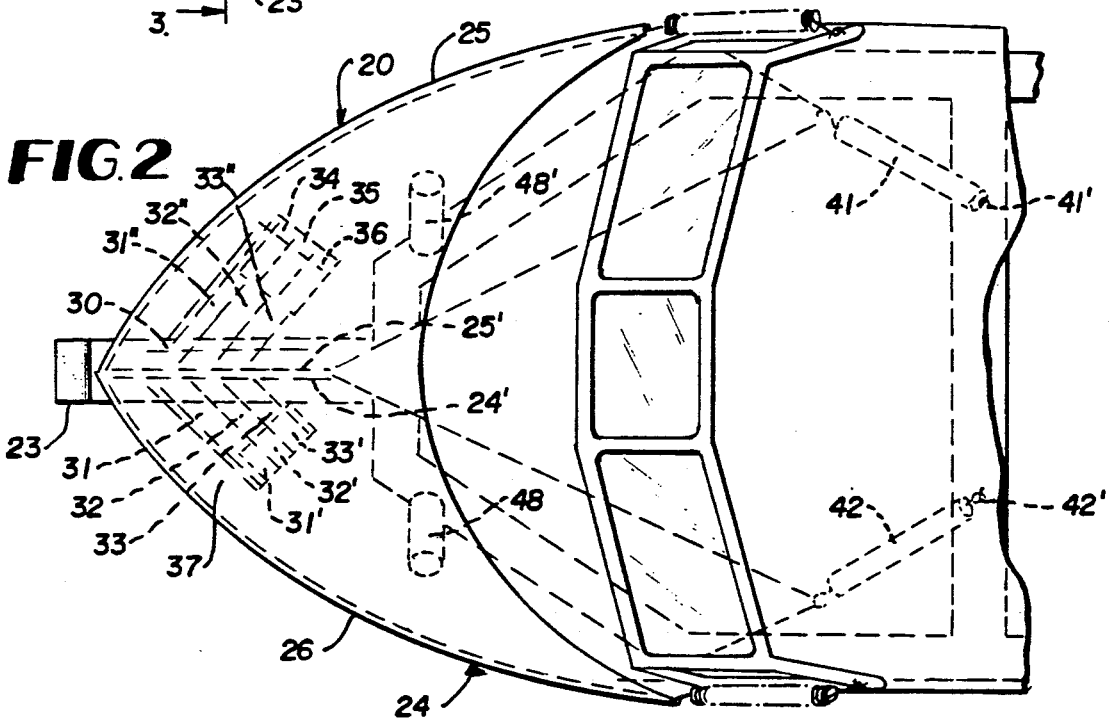
FIG. 2 is a top plan view of the boat cover invention shown mounted to the forward portion of the boat, while the boat is mounted on a trailer.
Figure 3:
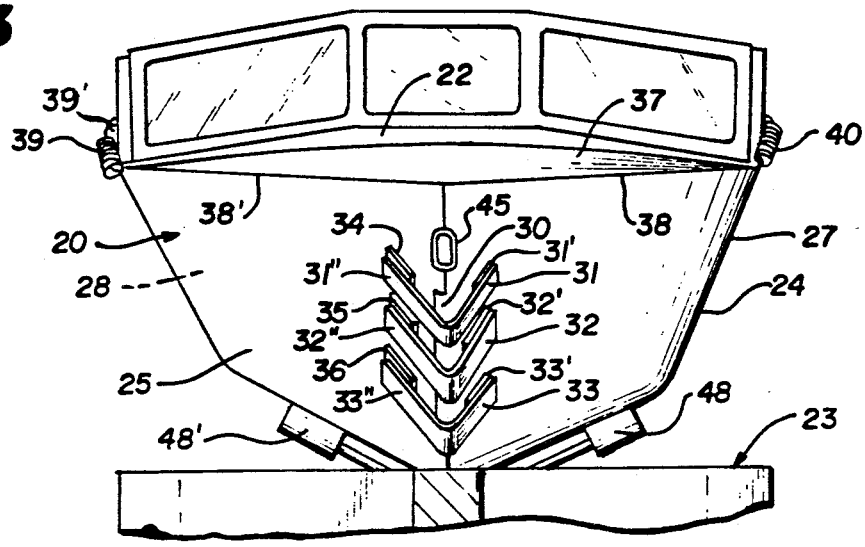
FIG. 3 is a front elevational view taken along line 3—3 of FIG. 1.

Referring more particularly to the drawing, in FIGS. 1, 2, and 3, the boat tarp invention 20 is illustrated shown attached to the forward portion 22 of the boat, with the boat mounted on a trailer 23.

The boat tarp cover device 20 has a pair of side portions 24 and 25 which are connected together along the upper end portions 26 and which drape down around the bottom sides 27 and 28 of the boat. The lower edges 24' and 25' of the sides 24 and 25 meet one another along the keel 29 of the boat, and side 24 has a flap 30 which is attached to the side 24 and extends over the edge 25' of side portion 25. Three elastic strips 31, 32, and 33 have their one ends 31', 32', and 33' attached to side portion 24 and each have adhesive mounted along their other ends 31", 32", and 33". Three adhesive strips 34, 35, and 36 are mounted to the side portion 25. The strips 31, 32, and 33 are drawn about the keel of the boat by stretching the elastic strips about the keel and the adhesive strips of the elastic strips are attached to the velcro strip 34, 35, and 36, respectively, to lock the side 24 to the side 25 about the keel with the flap 30 overlapping the edge 25' of side 25, and with the elastic strips taut about the keel and tight against the boat to keep the side portions 24 and 25 taut about the sides of the boat.

A third panel section 37 is sewn between the upper portions 38 and 38' of sections 24 and 25 of the tarp. It covers a portion of the top of the forward end of the boat when the tarp is attached. A pair of coil springs 39 and 40 are attached to the upper rear edges of the sections 24 and 25 of the tarp and have hooks 39' and 40' mounted to their outer ends. A similar pair of coil springs 41 and 42 are attached to the lower rear edges of sections 24 and 25 of the tarp and also have hooks 41' and 42' at their outer ends.

OPERATION

The tarp is easily attached to the boat by placing the tarp over the very nose 43 of the boat where the three sections connect, and then draping the sides or section 24 and 25 down along the bottom sides 27 and 8 of the boat. The elastic strips 31, 32, and 33 are stretched and then drawn over the keel of the boat and the adhesive portions 31", 32", and 33" of strips 31, 322, and 33 are attache to adhesive strips 34, 35, and 36 of section 25 to draw the sections together at the keel and forward portions of the keel or bow, as illustrated in the drawing. The hooks 39' and 40' of the tarp are then attached to the boat into eyelets on the boat mounted near the side windows of the boat with the springs expanded to keep the sides taut. The hooks 41' and 42' of springs 41 and 42 are then attached to eyelets mounted on the trailer frame, with the eyelets similarly placed to the eyelets for the springs 39 and 40 to place the springs 41 and 42 under expansion tension when their hooks are attached to keep the lower rear sections of the tarp taut against the sides of the boat.

The tarp 20 also has an opening 45 to allow the eyelet mounted to the front of the boat to be attached to a hook at the end of a cable on a conventional winch of a boat trailer to draw the boat to the trailer and onto the trailer, and secure the boat to the trailer.

The edges of sections 24 and 25 are not connected and are separate from one another, except where they are sewn to section 37. The forward edges 24' and 25' of sections 24 and 25 are separate from one another, except by the attachment of straps 31, 32, and 33 to the adhesive of section 25; and the flap 30 only covers the edge 25' of section 25.

The tarp may be made of rubberized nylon which provides sufficient strength and density to prevent rocks as are thrown up against the tarp, when the tarp is covering a boat, customarily from penetrating through the material enough to damage the boat.

When attaching the tarp to the boat while the boat is mounted on a trailer, the tarp section edges may be easily slid down between the rollers 48 and 48' on the trailer, by lifting the boat up slightly away from the trailer, and the flap portion 30 may be slid between the boat and the aligning roller 46 on the trailer by sliding the boat rearwardly on the trailer.

It will thus be seen that a novel boat tarp has been provided for covering the forward portion of a boat that can be easily made and attached to the boat to protect the boat from damage when being towed on a trailer from the rock and other materials.

It will be obvious that various changes and departures may be made to the invention without departing from the spirit and scope thereof, and accordingly, it is not intended that the invention be limited to that specifically described in the specification or as illustrated in the drawing, but only as set forth in the appended claims wherein:

What is claimed is:

1. A boat tarp cover device for attachment to a forward bowt part of a boat, said tarp comprising a pair of side panels and a triangular top panel having three converging sides with two of the sides opposing one another and converging forward toward one another, said two side panels having their upper edges connected to the top panel along the two forward converging sides of the top panel, one of the side panels having a plurality of adhesive acting strips along its lower edges, said other side panel having a plurality of adhesive acting strips along the lower edge of the other side panel, said tarp device being adapted to be mounted to a boat by placing the tarp device over the nose of the bow at the forward portion of the boa:, where the three panels converge toward one another, draping the side panels down along the opposing sides of the boat, and drawing the strips of the one side panel beneath the boat and attaching them to the adhesive strips on the other side panel, spring means having their one ends mounted along the rear of the side panels at their one ends and having hooks at their other ends for attachment adjacent the sides of the boat to keep the side panels taut against the sides of the boat.

2. A boat tarp device for attachment to a forward bow part of a boat, said device comprising a top panel portion with two opposite converging side edges, a pair of side panel portions having their upper edge portions mounted to the two converging side edges of the top panel, means along the bottoms of the side panels to connect the side panels together, whereby the device may be placed over the nose of the bow of the boat with the top panel resting on the top of the bow of the boat and the two side panel portions draped along the opposite sides of the boat and with the means connecting the side panels together being connected together beneath the boat, said means connecting side panels being adjustable to enable the side panels to be taut against the sides of the boat.

3. A boat tarp device comprising a flexible substantially cone-shaped cover device for covering the forward end of a boat, said cover having three sides connected together and converging toward one another at their forward ends, a longitudinal slit along the cover device between the first and third sides, whereby the device may be placed over the nose of the forward end of the boat, with the second side resting on top of the bow of the boat and the first and third sides draped along the opposite sides of the boat, means connecting the second and third sides together beneath the boat.

* * * * *